US005158289A

United States Patent [19]

Okumoto et al.

[11] Patent Number: 5,158,289

[45] Date of Patent: Oct. 27, 1992

[54] GOLF CLUBS

[75] Inventors: Takaharu Okumoto, Chigasaki; Tadashi Hayashida; Tetsuo Hayashi, both of Hiratsuka; Toshio Ninomiya, Isehara, all of Japan

[73] Assignee: The Yokohama Rubber Co., Ltd., Tokyo, Japan

[21] Appl. No.: 739,417

[22] Filed: Aug. 2, 1991

[30] Foreign Application Priority Data

| | | | |
|---|---|---|---|
| Aug. 15, 1990 | [JP] | Japan | 2-214426 |
| Aug. 30, 1990 | [JP] | Japan | 2-226730 |
| Aug. 30, 1990 | [JP] | Japan | 2-226731 |

[51] Int. Cl.[5] ..... A63B 52/10; A63B 53/04

[52] U.S. Cl. ..... 273/80 R; 273/167 J; 273/167 R

[58] Field of Search ..... 273/167 R, 167 J, 78, 273/80 R, 26 B, 67 R, DIG. 3, 167 A–167 H, 167 K, 168, 80 A–80 C, 80.2–80.9

[56] References Cited

U.S. PATENT DOCUMENTS

| | | | |
|---|---|---|---|
| Re. 32,958 | 6/1989 | Koshii et al. | 525/476 |
| 2,908,502 | 10/1959 | Bradstreet | 273/167 J |
| 4,241,115 | 12/1980 | Temin | 273/167 R |
| 4,417,006 | 11/1983 | Graziano | 523/435 |
| 4,504,520 | 3/1985 | Kurahashi | 273/167 R |
| 5,028,464 | 7/1991 | Shigetoh | 273/80 R |

FOREIGN PATENT DOCUMENTS

| | | | |
|---|---|---|---|
| 0026929 | 2/1977 | Japan | 273/167 J |
| 1085679 | 3/1989 | Japan | 273/167 R |
| 2080069 | 3/1990 | Japan | 273/167 R |

*Primary Examiner*—V. Millin
*Assistant Examiner*—Steven B. Wong
*Attorney, Agent, or Firm*—Finnegan, Henderson, Farabow, Garrett & Dunner

[57] ABSTRACT

A golf club wherein at least the surface of the face of a club head made of fiber-reinforced plastic or wood or the surface of a club shaft made of fiber-reinforced plastic is covered with a cured coating layer of a silicone-modified synthetic resin.

4 Claims, 3 Drawing Sheets

GOLF CLUBS

BACKGROUND OF THE INVENTION

The present invention relates to a golf club, and more particularly, to a golf club head with its face or the club's shaft surface having an improved scratching resistance.

Some of the golf clubs now on the market have a head made of a fiber-reinforced plastic (hereinafter referred to as FRP), a plastic reinforced with a fiber such as carbon fiber, glass fiber or aromatic polyamide fiber. Such a golf club has a tendency that its face (ball hitting surface) is liable to be scratched with small stones, sand or the like when a ball is hit therewith from a rough or a bunker. Particularly, in the case of a bunker shot, the head gets countless scratches by only one shot which can cause fading of the face or even chipping thereof in some cases. The scratch not only deteriorates the appearance of the club head, but also brings about the danger that the surface layer of the head will separate, permitting water to permeate into the head through the damaged areas and lower the strength of the head itself.

Further, some of the golf clubs on the market have a shaft made of a FRP instead of a steel shaft. When such a golf club is put in a caddie bag and carried on a vehicle or the like, it is apt to move around violently in the bag causing the shaft of such a club to collide against an iron club head, so that the shaft is scratched significantly which will cause fading in some cases, which not only deteriorates the appearance of the club shaft, but also is a cause of the breakage thereof.

One proposed means for protecting the surface of a club head or shaft made of a FRP comprises spraying a ceramic thermal layer on the surface. Since, however, a ceramic thermal layer is so poor in its adhesiveness to such a club head or shaft that it is liable to peel off, this means is insufficient as a protective surface.

SUMMARY OF THE INVENTION

An object of the present invention is to provide a golf club having an FRP or wooden head that has improved scratching resistance of at least the surface of the club's face. Another object of the present invention is to provide a golf club having an FRP shaft which has improved scratching resistance of the shaft's surface.

The present invention achieves these objects by forming a cured coating layer of a silicone-modified synthetic resin so as to cover at least the surface of the face of an FRP or wooden club head or the surface of an FRP club shaft.

The cured coating layer of a silicone-modified synthetic resin formed on the surface of a club face or a club shaft enhances the surface hardness of the face or the shaft and remarkably improves the scratching resistance thereof. As a result, the face or the shaft can be prevented from scratching, fading bruising and breaking that can occur when a ball is hit therewith or during the carriage thereof. Accordingly, the club face and shaft according to the present invention are improved in appearance and the service lives thereof are prolonged.

DESCRIPTION OF PREFERRED EMBODIMENTS

Figure 1:
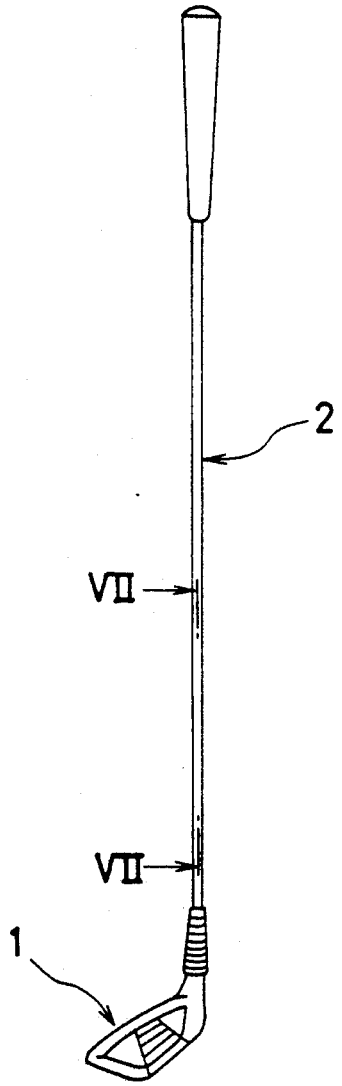
FIG. 1 is an elevational view of a wood-type golf club according to the present invention.
Figure 2:
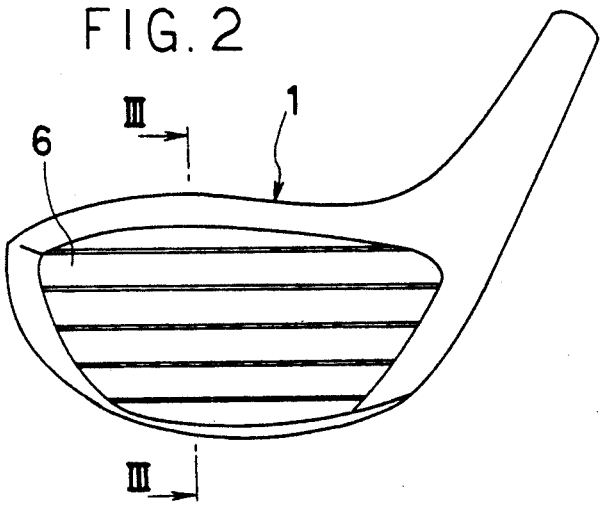
FIG. 2 is an enlarged elevation of the club head of a wood-type golf club according to the present invention.
Figure 3:
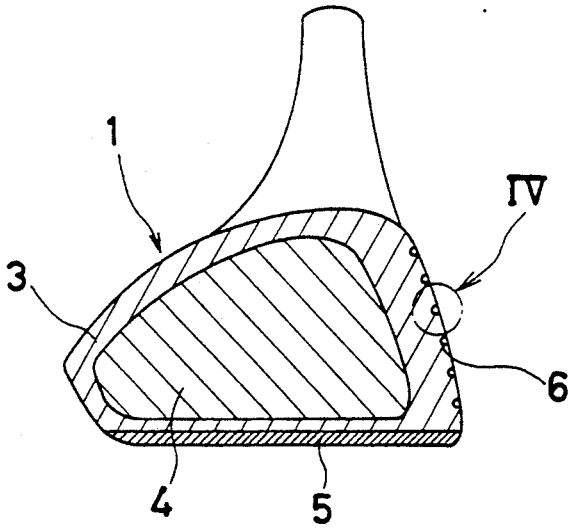
FIG. 3 is a cross sectional view of the club head taken along line III—III of FIG. 2.
Figure 4:
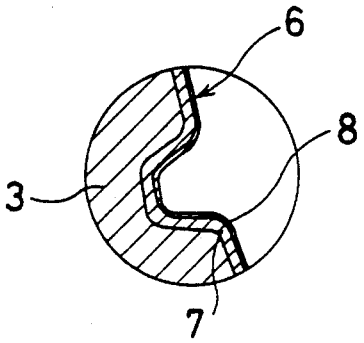
FIG. 4 is an enlarged view of area IV of FIG. 3.

As shown in FIG. 1, a golf club comprises a club head 1 and a club shaft 2. FIGS. 2 and 3 show a wood-type golf club having a head 1 made of FRP having a face 6, wherein the head is integrally constructed of a shell 3 made of FRP, a core 4 packed in the shell, and a metallic sole plate 5 fixed to the bottom. As shown in FIG. 4, the impact surface of the face 6 of the head 1 is covered with a urethane coating layer 7 which is further covered with a cured coating layer 8 comprising a silicone-modified synthetic resin.

The cured coating layer 8 can impart excellent scratching resistance not only to an FRP club head but also to a wooden club head made of persimmon wood or the like. However, the application of the layer to the FRP head is more effective than that to the wooden head, because the adhesiveness of a silicone-modified synthetic resin to a FRP is higher than that to wood.

Figure 5:
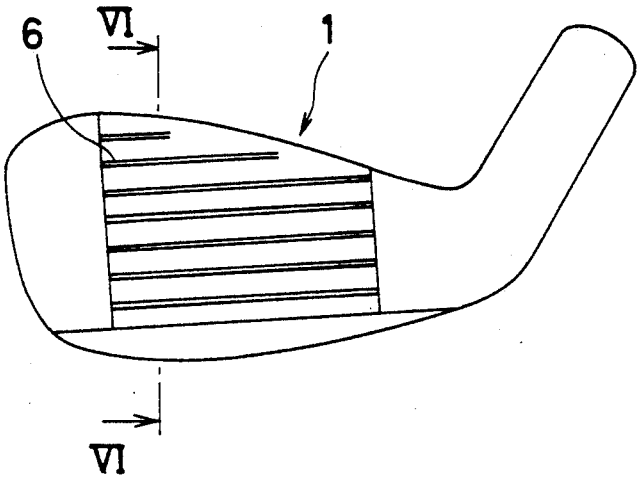
FIG. 5 is an enlarged elevational view of the club head of an iron-type golf club according to the present invention.
Figure 6:
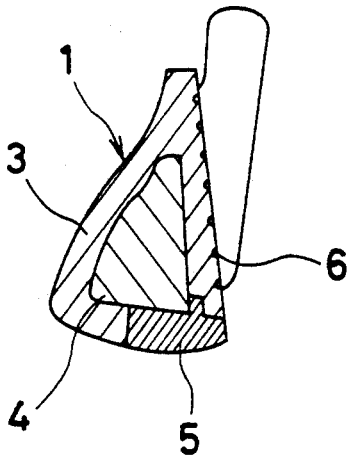
FIG. 6 is a cross sectional view of the club head taken along line VI—VI of FIG. 5.

The cured coating layer of a silicone-modified synthetic resin can be applied also to an iron-type golf club having an FRP club head. FIGS. 5 and 6 show, a club head of an iron-type golf club, the construction of which is the same as that of the wood-type golf club head shown in FIGS. 2 and 3, though the two heads are different from each other in shape.

Figure 7:
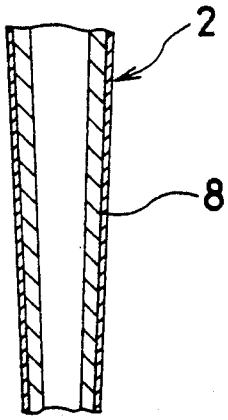
FIG. 7 is a cross sectional view of a portion of a club shaft taken along line VII—VII of FIG. 1.

Further, the cured coating layer of a silicone-modified synthetic resin can be applied to a golf club having an FRP shaft. FIG. 7 shows such a club shaft, in which a cured coating layer 8 of a silicone-modified synthetic resin is formed on the surface of the FRP shaft 2.

The FRP comprises at least one fibrous reinforcement selected from among carbon fiber, glass fiber, aromatic polyamide fiber (aramid fiber) and so on and at least one matrix resin selected from among epoxy resin, unsaturated polyester resin, polyimide resin and so on. A FRP comprising carbon fiber and an epoxy resin is particularly preferred from the standpoint of its adhesiveness to the cured coating layer.

It is preferable that the pencil hardness of the coating layer 8 formed on the surface of the face 6 of the club head 1 or the shaft 2 be 5H or above, because the scratching resistance of the surface of the face or the shaft can be remarkably improved thereby.

The term "pencil hardness" used in this specification refers to the hardness determined according to the method stipulated in JIS K 5400.

In accordance with the present invention, such a high-hardness coating layer excellent in scratching resistance can be made of a cured film of a silicone-modified synthetic resin and this cured film can adhere firmly to the surface of the club face or shaft described above.

Suitable silicone-modified synthetic resins include silicone-modified epoxy resin, silicone-modified acrylic resin and mixtures of them. More particularly, a suitable mixture comprises a silicone-modified epoxy resin (A), an aminosilane compound (B), an epoxysilane compound (C) and a dicarboxylic acid anhydride (D).

An example of a silicone-modified epoxy resin (A) is a resin prepared by reacting a bisphenol A epoxy resin [a product of Shell Chemical, "Epikote 828" (trade name)] with methylphenylpolysiloxane polymer having as an average repeating unit in the polymer chain a group of the formula: $(CH_3)_{0.70}(C_6H_5)_{0.35}(OH)_{0.28}SiO_{1.34}$ in the presence of 2-ethylhexanoic acid as a catalyst in xylene under heating. The aminosilane compound (B) includes amino-methyltri-methoxysilane and γ-aminopropyltriethoxysilane. The epoxysilane compound (C) includes β-glycidoxyethyldibropoxysilane and β-(3,4-epoxycyclohexyl)ethyltrimethoxysilane. Further, the dicarboxylic acid anhydride (D) includes phthalic anhydride and tetrahydrophthalic anhydride.

The components (B) and (C) may be added in a sum total of 2 to 100 parts by weight per 100 parts by weight of the component (A). If the sum total is less than 2 parts by weight, the adhesiveness of the resulting cured coating layer to the club face or the shaft will be poor, while if it exceeds 100 parts by weight, the resulting cured coating layer will be liable to crack.

The coating solution is prepared by mixing a silicone-modified epoxy resin (A) prepared by the above process with an aminosilane compound (B) and an epoxysilane compound (C) to give a homogeneous mixture and adding a dicarboxylic acid anhydride (D) and an organic solvent such as xylene to the mixture.

The coating solution thus prepared is uniformly applied to the surface of a club face or a shaft by spraying or coating, dried and cured by heating to give a cured coating layer.

Although it is desirable in respect of adhesiveness that the cured coating layer be formed directly on the surface of the FRP shell of a club head, the shell may be colored or coated with a conventional urethane resin 7 prior to the formation of the cured coating layer 8 according to the present invention.

EXAMPLE 1

A club head of a wood golf club was made from a FRP comprising carbon fiber and an epoxy resin. A urethane resin was applied to the surface of the face, solidified and roughly polished with a sandpaper (#320) or the like. The following coating composition A was applied to the urethane resin layer by spraying it on to a thickness of about 20 μm and then cured by heating at 80° C. for 3 hours to form a cured coating layer.

COATING COMPOSITION A 21 parts by weight of γ-aminopropyltriethoxysilane which aged at a room temperature and 22 parts by weight of β-(3,4-epoxycyclohexyl)ethyltrimethoxysilane were added to 100 parts by weight of a silicone-modified epoxy resin (epoxy equivalent: about 600) prepared by reacting 37.3 parts by weight of a bisphenol A epoxy resin [a product of Shell Chemical; "Epikote 828" (trade name)] with 12.4 parts by weight of methylphenylpolysiloxane polymer having as an average repeating unit in the polymer chain a group of the formula: $(CH_3)_{0.70}(C_6H_5)_{0.35}(OH)_{0.28}SiO_{1.34}$ in the presence of 0.7 part by weight of 2-ethylhexanoic acid as a catalyst in 50 parts by weight of xylene under heating at 160° C., followed by homogeneous mixing. 37 parts by weight of 4-methylhexahydrophthalic anhydride and 60 parts by weight of xylene were added to the obtained mixture as solvents. Thus, the coating composition A was prepared.

The cured coating layer thus formed was nearly transparent and exhibited a surface hardness as high as 9H as determined by the pencil hardness test. Further, the cured coating layer exhibited an excellent adhesiveness of 100/100 as examined by the following cross-cut adhesive cellophane tape test:

Cross-Cut Adhesive Cellophane Tape Test

The cured coating layer was cut so as to give 100 one-millimeter squares per square centimeter. Cellophane tape (trade name) was pressed against the cut area and then peeled off to determine the number of the squares of the cured coating layer that remained per 100 squares. A case wherein none of squares of the coating layer is peeled off at all is shown by 100/100.

A shot from a rough or the like was repeated with this wood golf club to determine the extent of scratching of the face. Although the face got a few scratches, it scarcely faded.

Various coating compositions were applied instead of the above coating composition A to form cured coating layers respectively having various surface hardnesses. The clubs thus obtained were examined for scratching resistance by repeating the shot from the rough or the like, by which it was ascertained that excellent scratching resistance as described above can only be attained when the pencil hardness of the cured coating layer is 5H or above.

EXAMPLE 2

The same procedure as that of Example 1 was repeated except that a one-pack coating composition (a product of Dainichiseika Color & Chemicals Mfg. Co., Ltd.; "DAIMETALON COAT") prepared from acrylic monomers and a silicone compound was applied instead of the coating composition A in a thickness of about 20 μm and thermally treated at 100° C. for 2 hours, thus forming a cured coating layer.

This cured coating layer was nearly transparent and exhibited a surface hardness of 7H as determined by the pencil hardness test and an adhesiveness of 100/100 as determined by the cross-cut adhesive cellophane tape test.

This wood golf club was examined for scratching resistance of its club face by repeating a shot from the rough or the like. The club did not fade, though it got a few scratches like that of Example 1.

EXAMPLE 3

In a similar manner to that of Example 1, a head of an iron golf club was made from a carbon fiber-reinforced plastic and a urethane resin was applied to the face of the club head, dried and solidified. This was followed by the formation of a cured coating layer thereon from the same coating composition A as the one used in Example 1.

The cured coating layer thus formed on the face was nearly transparent and exhibited a surface hardness of 9H as determined by the pencil hardness test and an adhesiveness of 100/100 as determined by the cross-cut adhesive cellophane tape test.

This iron golf club was examined for scratching caused by sand by repeating bunker shots therewith. Similarly to the wood golf club of Example 1, the iron golf club scarcely faded though it got a few scratches.

EXAMPLE 4

The same procedure as that of Example 3 was repeated except that a one-pack coating composition (a product of Dainichiseika Color Chemicals Mfg. Co., Ltd.; "DAIMETALON COAT" prepared from acrylic monomers and a silicone compound was applied in a thickness of about 20 μm instead of the coating composition A and thermally treated at 100° C. for 2 hours, thus forming a cured coating layer.

This coating layer was nearly transparent and exhibited a pencil hardness of 7H and an adhesiveness of 100/100 as determined by the cross-cut adhesive cellophane tape test.

This iron golf club was examined., for scratching caused by sand by repeating bunker shots therewith. The club exhibited a remarkably excellent scratching resistance like that of Example 3.

EXAMPLE 5

The surface of a carbon shaft made from a carbon fiber-reinforced epoxy resin was roughly polished with a sandpaper and the same coating composition A as that used in Example 1 was applied thereto in a thickness of about 20 μm and thermally treated at 80° C. for 3 hours to form a cured coating layer.

The cured coating layer thus formed on the shaft surface exhibited a pencil hardness of 9H and an adhesiveness of 100/100 as determined by the cross-cut adhesive cellophane tape test.

Further, a golf club was prepared by the use of this shaft to examine the characteristics as a golf club. No difference was found in the characteristics between this club and a conventional club with a carbon shaft coated with a urethane resin. That is, the characteristics of a carbon shaft were independent of its coating layer.

Further, the above carbon shaft coated with the composition A was examined for scratching resistance according to the following scratching test, by which it was ascertained that the extent of scratching which causes fading is remarkably lowered.

Scratching Test of Coating Surface

One set of golf clubs including iron golf clubs were made to lie in the trunk of a passenger car in a caddie bag and the clubs were vibrated continuously for 48 hours. The extent of scratching of the shaft surface of each iron golf club was visually compared with that of the shaft surface of a conventional iron golf club without any silicone-modified synthetic resin coating.

EXAMPLE 6

The same procedure as that of Example 5 was repeated except that a one-pack coating composition (a product of Dainichiseika Color & Chemical Mfg. Co., Ltd.; "DAIMETALON COAT") prepared from acrylic monomers and a silicone compound was applied in a thickness of about 10 μm instead of the coating composition A and thermally treated at 100° C. for 2 hours, thus forming a cured coating layer.

The cured coating layer thus formed on the carbon shaft surface exhibited a surface hardness of 7H as determined by the pencil hardness test and an adhesiveness of 100/100 as determined by the cross-cut adhesive cellophane tape test.

A golf club was prepared by the use of the above shaft to examine the characteristics as a golf club and scratching resistance. This club gave extremely excellent results like those of the club of Example 5.

What is claimed is:

1. A golf club head made form either a fiber-reinforced plastic or wood and having a face with an outer impact surface, wherein at least the outer impact surface of the face of said head is covered with a cured coating layer of a silicone modified synthetic resin comprising a mixture of:

(A) a silicone-modified epoxy resin prepared by reacting a bisphenol A epoxy resin with methylphenylpolysiloxane polymer having as an average repeating unit in the polymer chain a group of the formula: $(CH_3)_{0.70}(C_6H_5)_{0.35}(OH)_{0.28}SiO_{1.34}$ in the presence of 2-ethylhexanoic acid as a catalyst in xylene with heating;

(B) an amino-silane compound selected from the group consisting of aminomethyltrimethoxysilane and γ-aminopropyl-triethoxysilane;

(C) an epoxysilane compound selected from the group consisting of β-glycidoxyethyldipropoxysilane and β-(3,4-epoxycyclohexyl) ethyltrimethoxysilane; and (D) a dicarboxylic acid anhydride selected from the group consisting of phthalic anhydride and tetrahydrophthalic anhydride, wherein said mixture contains the amino-silane compound (B) and the epoxy-silane compound (C) in a total weight of from 2 to 100 parts by weight per 100 parts by weight of the silicone-modified epoxy resin (A).

2. A golf club comprising a club head and a club shaft made of fiber-reinforced plastic joined thereto, said shaft having an outer surface covered with a cured coating layer of a silicone modified synthetic resin comprising a mixture of:

(A) a silicone-modified epoxy resin prepared by reacting a bisphenol A epoxy resin with methylphenylpolysiloxane polymer having as an average repeating unit in the polymer chain a group of the formula: $(CH_3)_{0.70}(C_6H_5)_{0.35}(OH)_{0.28}SiO_{1.34}$ in the presence of 2-ethylhexanoic acid as a catalyst in xylene with heating;

(B) an amino-silane compound selected from the group consisting of aminomethyltrimethoxysilane and γ-aminopropyl-triethoxysilane;

(C) an epoxysilane compound selected from the group consisting of β-glycidoxyethyldipropoxysilane and β-(3,4-epoxycyclohexyl) ethyltrimethoxysilane; and (D) a dicarboxylic acid anhydride selected from the group consisting of phthalic anhydride and tetrahydrophthalic anhydride, wherein said mixture contains the amino-silane compound (B) and the epoxy-silane compound (C) in a total weight of from 2 to 100 parts by weight per 100 parts by weight of the silicone-modified epoxy resin (A).

3. The golf club of claim 2, wherein said golf club is a wood-type one.

4. The golf club of claim 2, wherein said golf club is an iron-type one.

* * * * *